United States Patent [19]

Dillon, Jr.

[11] Patent Number: 5,062,160

[45] Date of Patent: Nov. 5, 1991

[54] RAGLAN SLEEVE SURGICAL GOWN

[75] Inventor: John Dillon, Jr., El Paso, Tex.

[73] Assignee: Johnson & Johnson Medical, Inc., Arlington, Tex.

[21] Appl. No.: 532,920

[22] Filed: Jun. 4, 1990

[51] Int. Cl.[5] ..... A41D 13/12

[52] U.S. Cl. ..... 2/114; 2/DIG. 7

[58] Field of Search ..... 2/46, 49 R, 51, 52, 2/114, 75, 80, 88, 105, 106, DIG. 7

[56] References Cited

U.S. PATENT DOCUMENTS

| | | | |
|---|---|---|---|
| 2,668,294 | 2/1954 | Gilpin | 2/114 |
| 3,349,285 | 10/1967 | Belkin | 2/114 |
| 3,353,189 | 11/1967 | Zimmon | 2/114 |
| 3,570,012 | 3/1971 | Winters | 2/114 |
| 4,214,320 | 7/1980 | Belkin | 2/114 |
| 4,586,196 | 5/1986 | White | 2/114 |
| 4,622,699 | 11/1986 | Spriggs | 2/DIG. 7 |
| 4,920,578 | 5/1990 | Janzen et al. | 2/114 |

*Primary Examiner*—Werner H. Schroeder

*Assistant Examiner*—Jeanette E. Chapman

[57] ABSTRACT

The present invention provides surgical gowns and other garments possessing the advantages of raglan sleeve construction in terms of comfort and freedom of movement, with improved manufacturing efficiency. The garment of the present invention provides a raglan sleeve divided into an upper portion and lower portion joined approximately in the area of the bicep. Waste is greatly reduced by creating a shoulder portion from material removed to form the arm openings in the body portion of the garment. The shoulder portion is attached to the body portion of the garment to form a raglan shoulder portion which extends to about the bicep of the wearer. A sheet of material is cut in a trapezoidal pattern to form a plurality of lower sleeve portions, each of which is attached to a shoulder portion. Gowns made in accordance with the present invention exhibit the flow and shoulder lines of a raglan sleeve construction while making efficient use of the fabric from which the gown is constructed. Methods of making garments such as surgical gowns are also disclosed.

11 Claims, 6 Drawing Sheets

RAGLAN SLEEVE SURGICAL GOWN

The present invention relates to garments for use by medical personnel or their patients, and more specifically, to disposable surgical gowns.

BACKGROUND OF THE INVENTION

Medical gowns such as those worn by operating room personnel and others typically comprise a body portion and sleeves cut from a medical grade fabric, such as the many non-woven fabrics well known in the art. Many gowns sold today are disposable and are packaged in sterile wrappers. Since the pattern shapes from which the parts of the gown are cut are irregular, the design of the gown body and sleeves results in wasted fabric from the portions cut to provide arm and neck holes. Because these types of garments are manufactured in great quantities, it would be desirable both economically and environmentally to reduce waste to as great an extent as possible.

There are several constructions known in the art and applied to garments of this type, however, these designs inherently result in wasted material. A sleeve construction such as that disclosed in U.S. Pat. No. 3,803,640—Ericson is known generally as a "raglan" sleeve and is shaped so as to provide a seam running from beneath the juncture of the shoulder and the torso, partially across the chest and up to the neck opening. If a raglan sleeve were removed, split open and laid flat, the shoulder portion of the sleeve would have a "U" shaped end matching that made in the shoulder region of the body portion. These pieces are waste material, since the sleeve is sewn directly to the body.

Variations of the standard raglan sleeve are found in many other surgical gowns. For example, U.S. Pat. No. 4,586,196—White, discloses a disposable surgical gown having areas manufactured from material having a high degree of air permeability, while other portions of the gown are manufactured of materials which are liquid repellent or impermeable. The sleeve of the gown is divided into upper and lower portions at a seam disposed below the elbow area of the arm. The lower portion of the sleeve is comprised of a liquid impermeable material to protect the forearm of the wearer. Similar sleeve constructions are disclosed by U.S. Pat. Nos. 4,504,977—King et al. and 4,504,978—Gregory, Jr. et al., both of which teach forming a seam between the upper and lower sleeve portions at the elbow region of the wearer. Also, U.S Pat. No. 3,349,285—Belkin discloses a raglan sleeve divided into upper and lower sections at about the elbow and U.S. Pat. No. 3,011,172—Tames discloses a raglan sleeve construction having a lower sleeve section formed as an additional layer of material overlying the sleeve and having a seam below the elbow. However, all of these prior art designs utilize what is essentially a two piece sleeve, and do not reduce the waste occurring from the need to cut arm holes in the body portion of the gown and to make matching cuts in the sleeve portion.

A raglan sleeve design, as applied to a patient's comfort gown, is disclosed by U.S. Pat. No. 3,276,036—Cater. As seen particularly in FIGS. 2-4 of that reference, a sleeve may be formed using a typical raglan construction as described above. The sleeve is terminated above the bicep portion of the arm, i.e., just off the shoulder, to form a short sleeve garment. The sleeve portions are detachably affixed to the body portion of the garment, which is formed from two pieces of material and therefore has two side seams. The sleeve portions are formed from separate sleeve blanks of a dimension which results in each sleeve portion seam terminating at its respective side seam. Thus, the size of the cutouts required for the arm openings and the size of the sleeve sections required to correctly form the seams disclosed results in wasted fabric.

Another type of sleeve construction found in many garments is known generally as a "set in" sleeve. Many items of apparel utilize the set in construction, such as dress shirts, blouses and coats. The sleeve portion of a set in sleeve is substantially tubular or slightly tapered in the form of a truncated cone, therefore, if split and laid flat, the sleeve portion would be formed of a substantially rectangular or trapezoidal portion of material. Waste in the sleeve portion is thus reduced, but still occurs since the body portion has cutouts not unlike those required for a raglan sleeve, only smaller in size. Moreover, the set in sleeve is more difficult to construct and provides less freedom of movement to the wearer.

It would therefore be desirable to provide a garment construction which reduces waste material to an even greater extent than the set in sleeve, while providing the manufacturing and comfort advantages offered by raglan sleeves.

SUMMARY OF THE INVENTION

Accordingly, it has now been found that by cutting arm openings of an appropriate size in the body portion of a garment, shoulder portions may be constructed from the formerly wasted material. When attached to the body portion, the shoulder portion extends to cover the bicep of the wearer. A lower sleeve portion may the be attached to the shoulder portion to provide a long sleeve garment such as a surgical gown. Because wasted material is substantially eliminated, the garments of the present invention may be efficiently manufactured of disposable materials.

In a preferred embodiment, the present invention provides a garment comprising a body portion formed of a section of material which has a neck opening and two arm openings formed by removing sections of the material. Two shoulder portions are formed from the sections of material removed to make the arm openings, and therefore each has an area substantially equal to one of the arm openings in the body portion. The garment also comprises two lower sleeve portions, each affixed to one of the shoulder portions. As a result, the shoulder portions of the garment terminate between the shoulder and the elbow of the wearer and the lower sleeve portions of the garment extend downward toward the wrist of the wearer. Most preferably, garments made in accordance with the present invention are adapted for use as surgical gowns.

In a preferred embodiment, the body portion of the garment has two edges which are overlapped along the back of the wearer when the garment is worn. One or more means for securing the body portion of the garment to the wearer, most preferably tie straps, are also provided. In certain embodiments sleeve termination means, such as knit cuffs, for securing the lower sleeve portions to the wrists of the wearer, are also added.

The present invention also provides methods for constructing garments.

DETAILED DESCRIPTION OF THE PREFERRED EMBODIMENTS

Figure 1:
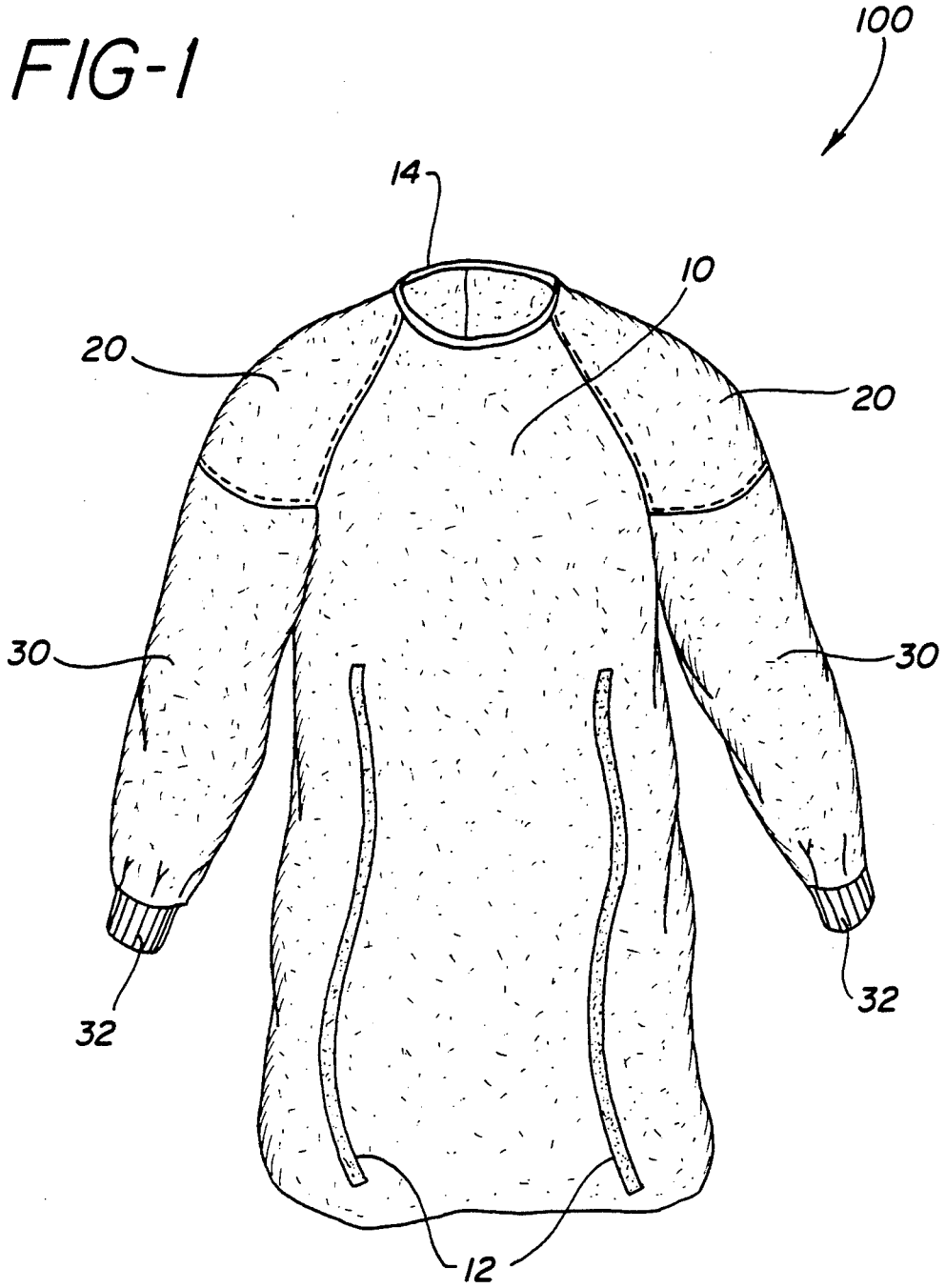
FIG. 1 is an isometric view of an operating gown made in accordance with the present invention.

Referring now to FIG. 1, there is shown a surgical gown 100 made in accordance with the present invention. Although FIG. 1 depicts a surgical gown, those of ordinary skill will understand that the construction and features of the present invention may be advantageously incorporated into other types of garments, including those worn by both patients and medical personnel. Such gowns, garments or covers may be worn in the operating room, during pre- and post- operative (peri-operative) procedures, or in other locations such as examination rooms or wards. Also, the present invention provides a garment construction particularly suited to use with non-woven, disposable fabrics, however, any fabric or similar material may be substituted depending upon the qualities desired in the resulting garment, such as absorbency, flexibility, etc.

As shown in FIG. 1, a surgical gown 100 made in accordance with the present invention will preferably comprise a body portion 10, a shoulder portion 20 and a lower sleeve portion 30. Most preferably, tie straps 12 are provided which are attached to the body portion 10, allowing the wearer to secure the gown 100 around the torso. The shoulder portions 20 are joined to the body portion 10 and thereby form a raglan sleeve construction. Preferably, the neck opening is surrounded with a suitable neck band 14 or other reinforcement. The lower end of the shoulder portions 20 lie at about the bicep of the wearer, i.e., on the arm between the shoulder joint and the elbow joint. The lower sleeve portion 30 is joined to the shoulder portion 20 and extends downwardly to about the wrist of the wearer, where it is preferably terminated by a knit wrist cuff 32, as typically used in the art. The distal end of the lower sleeve portion 30 may alternately be comprised of an elastic section or finished with a hem, or by other suitable means. The length which the lower sleeve section 30 extends down the arm may be varied as desired to cover more or less of the wearer's arm; however, in most instances where the garment is being worn to provide a barrier to infection and contamination, it will be desirable to extend the lower sleeve portion 30 to cover the wrist of the wearer.

Figure 2:
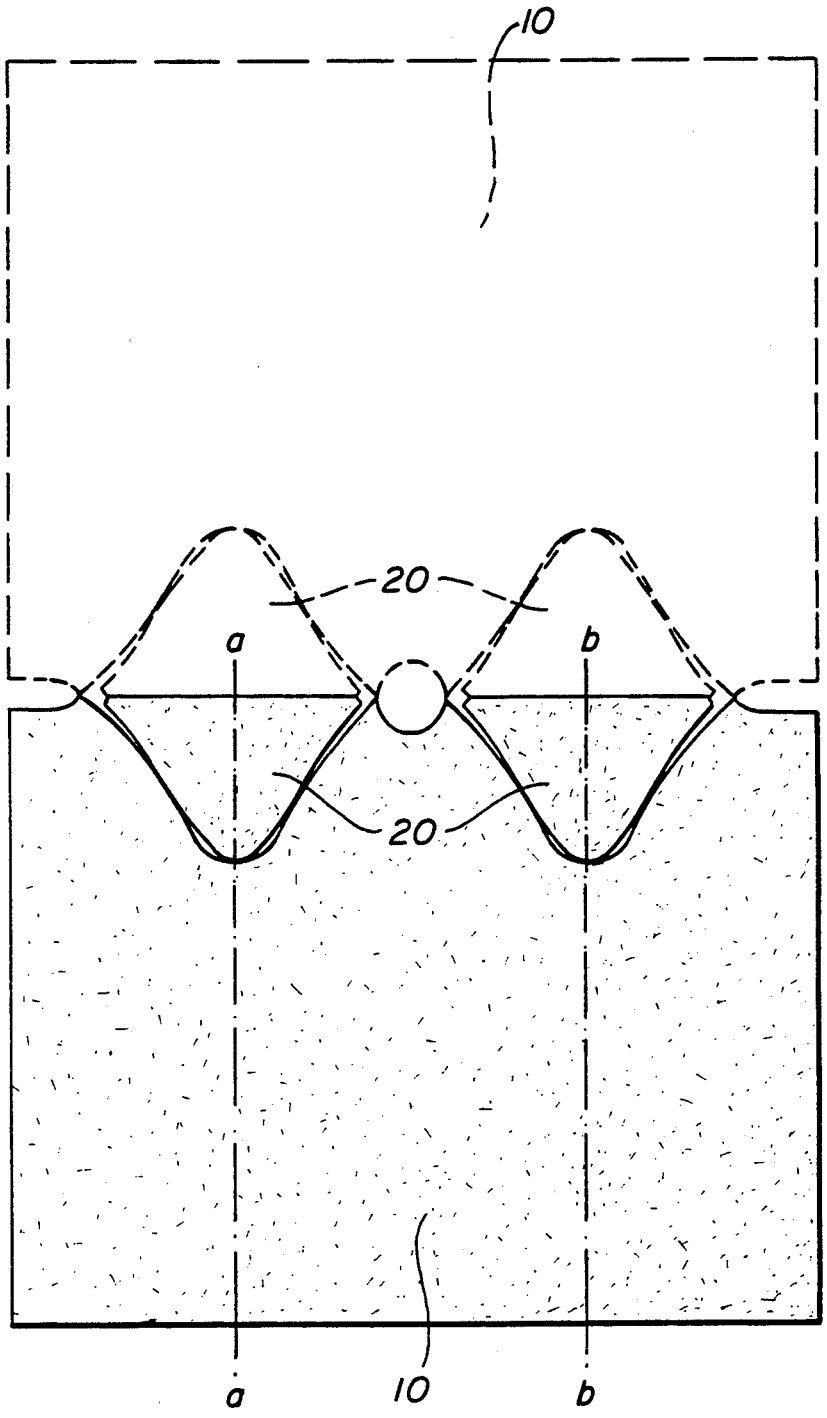
FIG. 2 illustrates, partially in phantom, a pattern for cutting fabric in order to construct the body and shoulder portions of the gown of FIG. 1.

A major advantage of the construction of the gown 100 depicted in FIG. 1 is that when the component portions of the gown are cut from a sheet of material, a substantially reduced amount of waste material is created. FIG. 2 illustrates a pattern for cutting fabric in order to construct the body portion 10 and shoulder portions 20 of the gown 100 depicted in FIG. 1. The body portion 10 is cut in the pattern shown, creating the arcuate pieces which comprise the shoulder portions 20. As shown in phantom, a second body portion 10 and shoulder portions 20 may be cut from a symmetrical "mirror image" pattern if desired. Alternatively, one of ordinary skill will be able to envision a pattern wherein the section shown in phantom in FIG. 2 is rotated 180°, thereby forming a periodic repeating pattern having all the components oriented in the same direction for each garment cut. As will be further understood by those of ordinary skill, depending upon the nature of the fabric comprising the garment of the present invention, it may be desirable in certain instances to cut multiple sections similar to that depicted in FIG. 2 by providing several layers of material which are cut simultaneously.

It should be noted that the lines delineating the body potion 10 and the shoulder portions 20 are not perfectly matched. It has been found that in order to provide a garment having a suitable appearance and degree of comfort, as depicted in FIG. 1, it is necessary to slightly trim the body portion 10 or the shoulder portions 20 in order to either achieve a correct fit and smooth seams. However, in certain embodiments of the present invention, the techniques used to construct the garment and the characteristics of the fabric may permit such trimming to be avoided while still providing an acceptable garment. Thus, the only wasted fabric which results when cutting the portions in FIG. 2 are the arcuate cutouts necessary to form a neck opening in the gown and any waste pieces resulting from the trimming described above.

Figure 3:
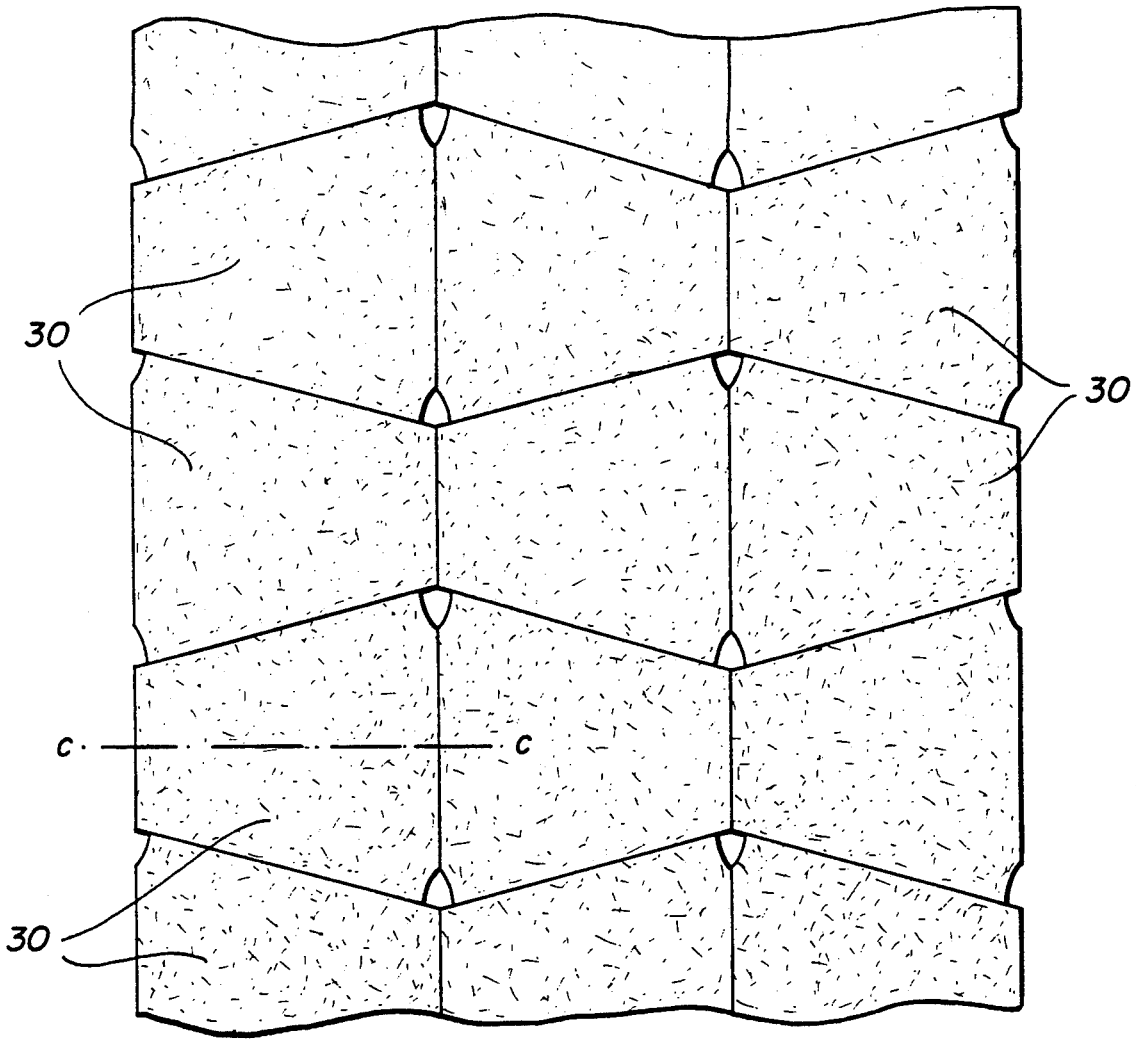
FIG. 3 illustrates a pattern for cutting fabric in order to construct the lower sleeve portions of the gown of FIG. 1.

Referring now to FIG. 3, there is depicted a pattern for cutting fabric in order to construct the lower sleeve portions 30 of the gown of FIG. 1. In a manner similar to that discussed above, the pattern layout for the lower sleeve portions 30 depicted is designed to minimize wasted fabric. The substantially trapezoidal sections of fabric are arranged in a repeating periodic pattern having substantially no waste, except the arcuate section cut from each corner of the base of each trapezoid. Unlike FIG. 2, the fabric of FIG. 3 preferably is not trimmed to create the lower sleeve portions 30, and therefore the pattern lines are depicted as straight cuts. Alternatively, rather than providing a second section of material as a sheet, a tubular section of material may be provided, such as a knitted tubular fabric section, which is then cut to length and directly attached to the shoulder portion 20 by a circumferential seam to form the lower sleeve portion 30 as depicted in FIG. 1.

Figure 4:
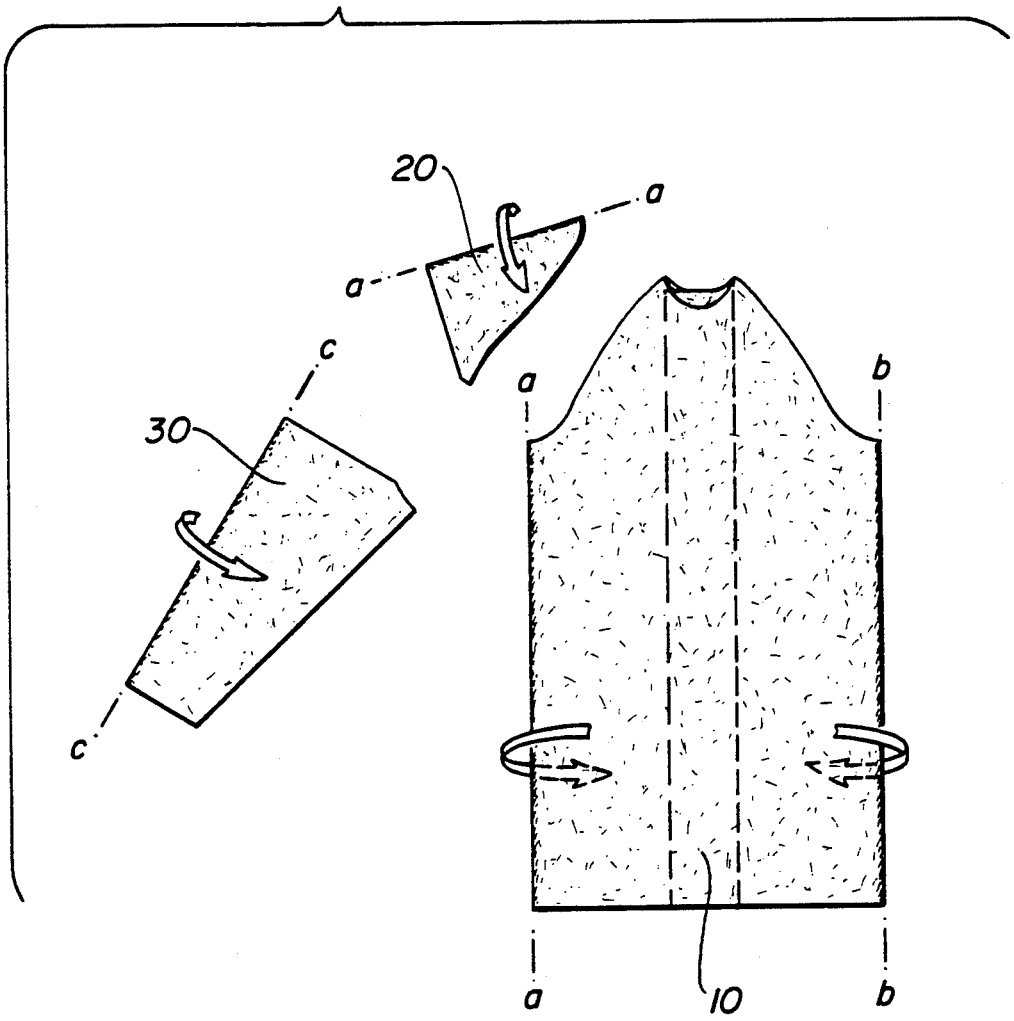
FIG. 4 is an exploded elevation View of the manner in which the pieces of fabric cut along the patterns shown in FIGS. 2 and 3 are attached to each other.

The assembly of the pieces cut from the fabric patterns illustrated in FIGS. 2 and 3 is shown in the exploded elevation view of FIG. 4. For illustrative purposes, only the construction of the right side of the gown is depicted, however, the opposite shoulder and sleeve portions are affixed in the same way. Referring to FIGS. 2 and 4, it can be seen that the body portion 10 is formed by folding the fabric of the gown 100 about the axes labelled "a—a" and "b—b" shown in both FIGS. 2 and 4. As shown by the arrows in FIG. 4, the lateral edges of the body portion 10 are brought substantially together, thereby forming a tubular body portion 10, as depicted, having arm and neck cutouts and a seam or overlap in the back of the garment, as shown by the dashed lines. The shoulder portion 20 is also folded about axis "a—a" as shown by the arrow in FIG. 4 and re-oriented slightly to the position shown, where it may be joined to the body portion 10 to form a substantially raglan sleeve construction. The lower sleeve section 30 is folded along its longitudinal axis "c—c" shown in FIGS. 3 and 4 in the manner shown by the arrow in FIG. 4 to produce a substantially tapered lower sleeve portion 30.

Figure 5:
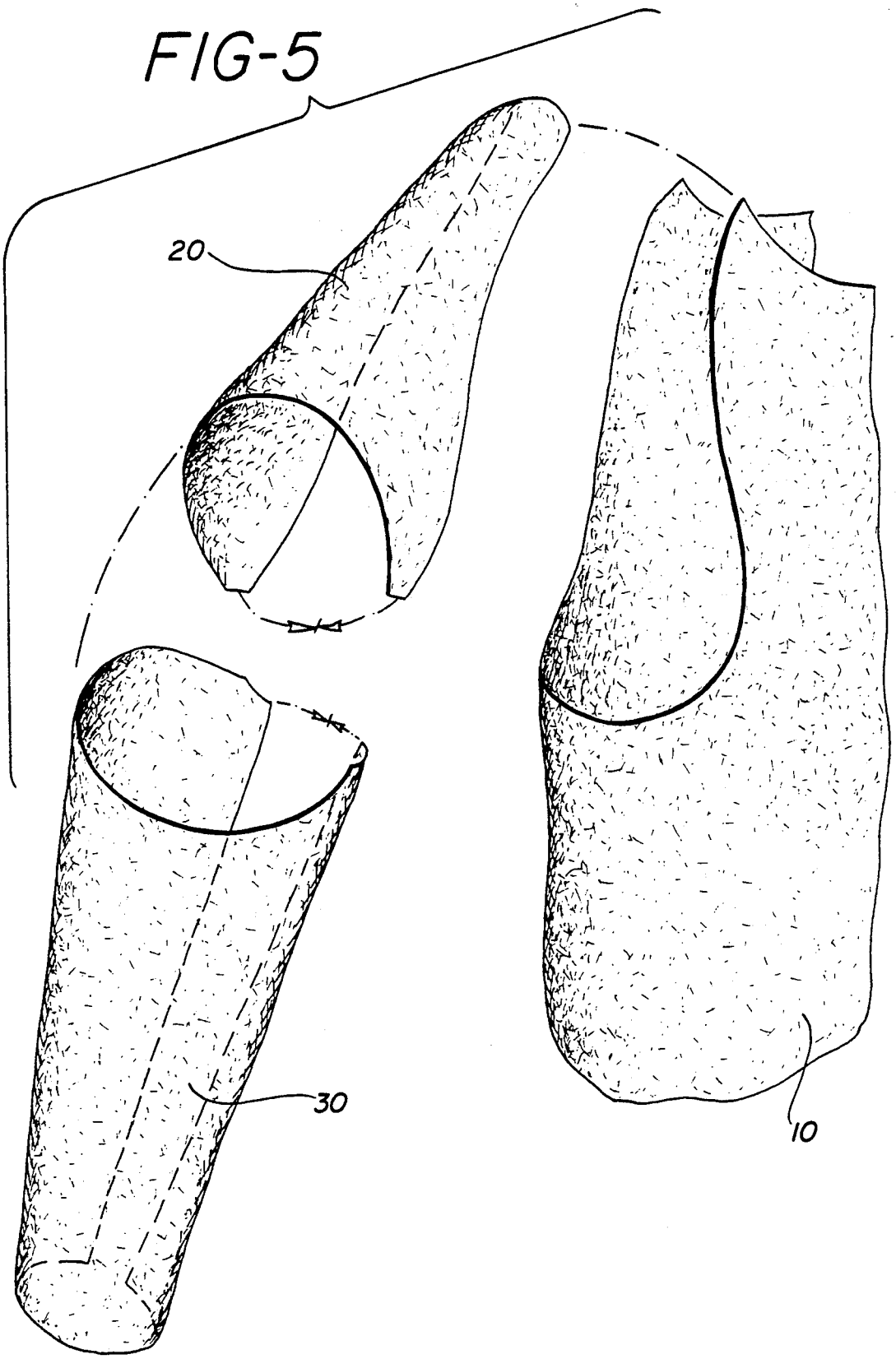
FIG. 5 is an exploded partial isometric view of the shoulder and lower sleeve section of the gown shown in FIG. 1.

A partial isometric view of the construction of the gown of the present invention is depicted in FIG. 5. As explained with reference to FIG. 4, the body portion 10 is folded or draped into a substantially tubular configuration such that an arm hole section is formed as depicted in FIG. 5. The armhole section is substantially the same as that which is formed when constructing a standard raglan sleeve. In accordance with the present invention, by appropriate cutting and trimming, as discussed above, the formerly wasted section of fabric may be utilized to create the shoulder portion 20, which is joined to the body portion 10. As seen in FIG. 5, the lower end of the shoulder portion 20 will form a substantially tubular shape which provides a transition to join the lower sleeve portion 30 with a simple circumferential seam or joint.

The completed sleeve and shoulder portion of the gown 100 described above is shown in FIG. 6, which is a partial isometric view of the gown 100 of FIG. 1 as worn on the body. For purposes of illustration, the body portion 10 has been omitted from this view. It can be seen that the shoulder portion 20 extends from the neck band 14 down, over the shoulder to approximately the bicep area of the wearer, creating a curved seam extending from the neck to the armpit, in the manner of a raglan sleeve. The size of the shoulder portion 20 and the distance it extends downwardly from the wearer's shoulder toward the elbow is a function of the cutout made for the armhole, as explained above. Since the shoulder portion 20 is formed from the fabric section resulting from the arm opening cut out, they will have about the same area. The lower section of the shoulder portion 20 is formed into a substantially tubular structure, which is affixed to the lower sleeve portion as depicted by the dashed lines in FIG. 6. The distal end of the lower sleeve portion 10 is preferably terminated with a knit cuff 32, as described above.

One of ordinary skill will realize that although it is preferable to construct the gowns 100 or other garments made in accordance with the present invention from a single type of material, the construction disclosed herein readily adapts to the use of two or more different materials. One type of material may be used to create the body portion 10 and shoulder portion 20, while another type of material having different characteristics may be used to form the lower sleeve section 30. However, since the relative length of the shoulder portion 20 and lower sleeve portion 30 are governed by the size of the cutout made in the body portion, the variations of this type of designs are somewhat limited.

The present invention also provides methods of gown construction. Preferably, the methods of making a garment in accordance with the present invention comprise providing a first section of material and cutting a neck opening and two arm openings by removing a portion of the material. A second section of material is then provided and two lower sleeve portions are cut from it. The next step includes forming a body portion of a garment from the first section of material and forming two shoulder portions form the portions of the first section of material removed to form the arm openings. Two sleeve portions are formed from the pieces cut from the second section of material and are attached to the shoulder portions. The shoulder portions are then attached to the body portion of the garment.

Most preferably, the methods of the present invention include the step of trimming the body portion or the shoulder portions to achieve a proper fit. Also, after the garment has been assembled, in certain embodiments, a knit cuff may be attached to the termination of the lower sleeve portion. As described above, the methods of the present invention may also be adapted to produce multiple pieces. Thus, in these embodiments, the first and the second sections of material will comprise multiple layers of material and the steps of cutting will comprise cutting the multiple layers simultaneously. A plurality of body portions, shoulder portions and sleeve portions will therefore be formed, permitting efficient mass production.

Figure 6:
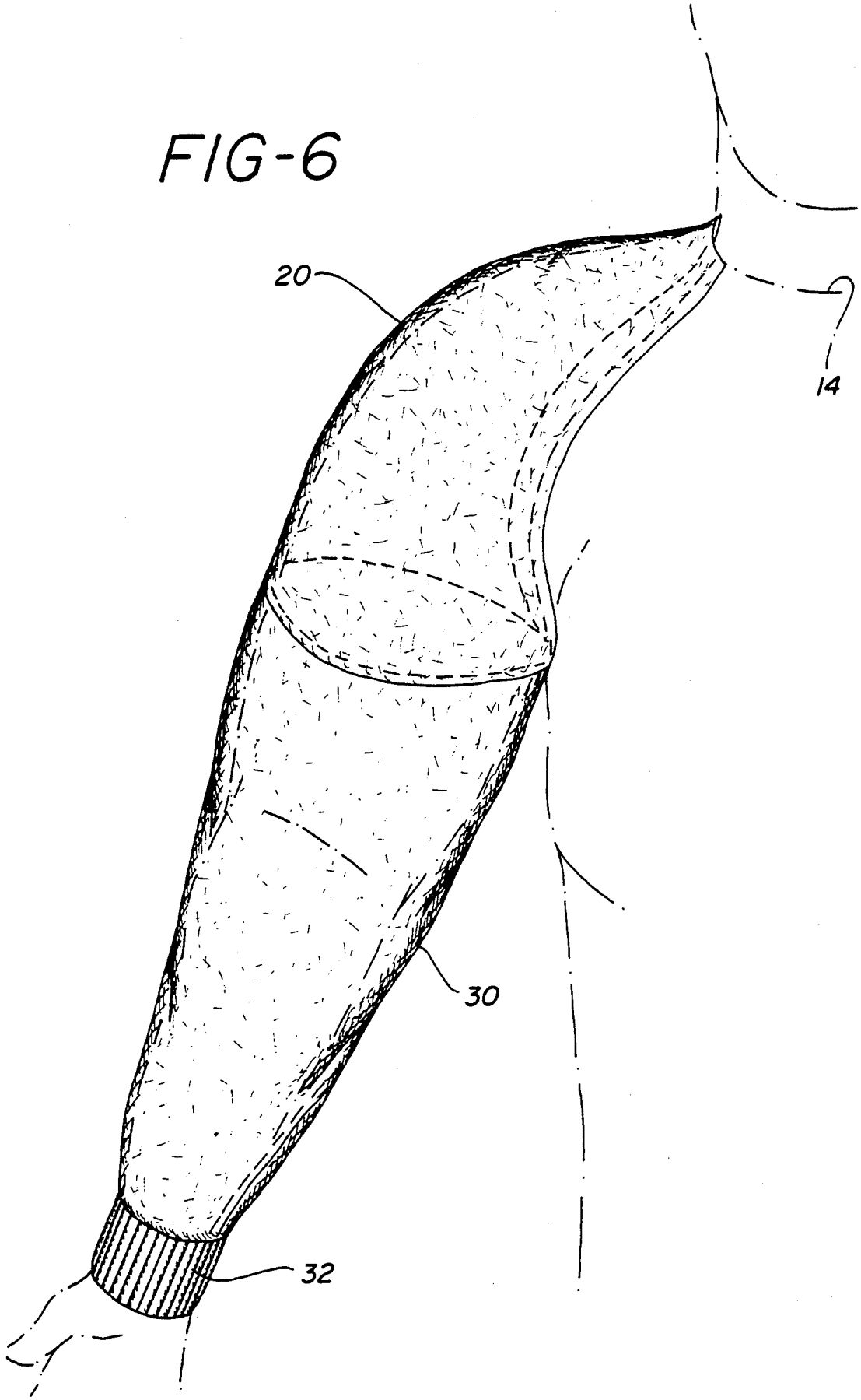
FIG. 6 is a partial isometric view of the sleeve and shoulder portions of the gown of FIG. 1 as worn on the body.

The joints and seams depicted in FIG. 6 and described above are most preferably stitched joints between two or more layers of overlapped fabric. Thus, in accordance with the methods of the present invention, the steps of attaching the shoulder portions to the body portions and of attaching the sleeve portions to the shoulder portions comprises sewing a seam. In some instances, however, it may be preferred to used adhesives or heat fusion to form these seams. Alternatively, mechanical fasteners such as zippers, snaps or velcro-type fastening systems may be preferred.

Although certain embodiments of the present invention have been described with particularity, these descriptions are not meant to be limiting. One of ordinary skill will realize numerous useful modifications and adaptations to the present invention without substantially departing from the spirit of the embodiments disclosed. Accordingly, reference should be made to the appended claims in order to determine the scope of the present invention.

What is claimed is:

1. A garment comprising:

a single body portion formed of a sheet of material and having a neck opening and two arm openings formed by removing sections of the material;

two shoulder portions, each formed of material having been removed from the arm openings in the body portion; and two lower sleeve portions, each affixed to one of the shoulder portions, whereby the shoulder portions terminate between the shoulder and the elbow of the wearer and the lower sleeve portions extend downward toward the wrist of the wearer.

2. The garment of claim 1 wherein the garment is adapted for use as a surgical gown.

3. The garment of claim 1, wherein the body portion has two edges which are overlapped along the back of the wearer when the garment is worn.

4. The garment of claim 3, further comprising means for securing the body portion of the garment to the wearer.

5. The garment of claim 4, wherein the securing means comprise tie straps.

6. The garment of claim 1, further comprising sleeve termination means for securing the lower sleeve portions to the wrists of the wearer.

7. The garment of claim 6, wherein said sleeve termination means comprise knit cuffs.

8. The garment of claim 1, wherein the garment comprises a disposable material.

9. The garment of claim 8, wherein the disposable material is a non-woven material.

10. The garment of claim 1, wherein the lower sleeve portion comprises a substantially trapezoidal section of material.

11. The garment of claim 1, wherein the lower sleeve portion comprises a substantially tubular section of material.

* * * * *